US010220281B2

(12) United States Patent
Luo et al.

(10) Patent No.: US 10,220,281 B2
(45) Date of Patent: Mar. 5, 2019

(54) PORTABLE BASKETBALL ARCADE

(71) Applicant: TRI-GREAT INTERNATIONAL LTD., Dongguan (CN)

(72) Inventors: Chunfang Luo, Dongguan (CN); Ming Li, Dongguan (CN)

(73) Assignee: TRI-GREAT INTERNATIONAL LTD., Dongguan (CN)

( * ) Notice: Subject to any disclaimer, the term of this patent is extended or adjusted under 35 U.S.C. 154(b) by 0 days.

(21) Appl. No.: 15/906,811

(22) Filed: Feb. 27, 2018

(65) Prior Publication Data

US 2018/0250567 A1 Sep. 6, 2018

(30) Foreign Application Priority Data

Mar. 3, 2017 (CN) ..... 2017 2 0203410 U

(51) Int. Cl.

| | |
|---|---|
| ***A63B 63/08*** | (2006.01) |
| ***A63B 69/00*** | (2006.01) |
| ***A63F 7/06*** | (2006.01) |
| *A63F 7/36* | (2006.01) |
| *A63B 63/00* | (2006.01) |

(52) U.S. Cl.

CPC ..... *A63B 63/083* (2013.01); *A63B 69/0071* (2013.01); *A63F 7/0608* (2013.01); *A63B 2063/001* (2013.01); *A63B 2225/093* (2013.01); *A63F 2007/3655* (2013.01)

(58) Field of Classification Search

CPC ..... A63B 63/083; A63B 69/0071; A63B 2063/001

USPC ..... 273/397–402; 473/472, 47, 433

See application file for complete search history.

(56) References Cited

U.S. PATENT DOCUMENTS

| | | | | | |
|---|---|---|---|---|---|
| 4,805,917 | A * | 2/1989 | Cochran | A63B 47/025 | 273/397 |
| 4,838,549 | A * | 6/1989 | Woodall | A63B 47/025 | 473/433 |
| 5,074,552 | A * | 12/1991 | Gomez | A63B 69/0071 | 273/402 |
| 5,133,546 | A * | 7/1992 | Matherne | A63B 24/0021 | 273/375 |
| 5,171,009 | A * | 12/1992 | Filewich | A63B 63/083 | 473/433 |
| 5,246,225 | A * | 9/1993 | Matherne | A63B 24/0021 | 273/375 |

(Continued)

*Primary Examiner* — Mark Graham

(74) *Attorney, Agent, or Firm* — Hemisphere Law, PLLC; Zhigang Ma

(57) ABSTRACT

The present invention provides a portable basketball arcade, including a backboard, two basketball rims, two telescopic support upright rods, two telescopic support bottom rods, two telescopic reinforcing rods and a support bottom rod. The above portable basketball arcade is simple in structure, by pivoting connection of a plurality of telescopic rods, the angles among respective rods and the height of the basketball arcade are convenient to adjust, such that different heights and distances are provided for users to practice, the portable basketball arcade can be simply and rapidly folded and stored without a need of tools, and the folded basketball arcade is small in occupied space, and convenient to carry and lift; and the basketball arcade is equipped with the ball receiving plate and the side nets, which are convenient for the users to pick up the ball for practice.

20 Claims, 4 Drawing Sheets

(56) References Cited

U.S. PATENT DOCUMENTS

| | | | | | |
|---|---|---|---|---|---|
| 5,312,099 | A * | 5/1994 | Oliver, Sr. | A63B 63/083 | 473/433 |
| 5,364,091 | A * | 11/1994 | Sebek | A63B 69/0071 | 473/433 |
| 5,443,259 | A * | 8/1995 | Segan | A63B 63/083 | 273/123 A |
| 5,692,976 | A * | 12/1997 | Yu | A63B 63/083 | 273/397 |
| 5,813,926 | A * | 9/1998 | Vance | A63B 63/083 | 473/433 |
| 5,833,557 | A * | 11/1998 | Cole | A63B 5/11 | 473/472 |
| 6,929,569 | B1 * | 8/2005 | Wang | A63B 24/0021 | 473/433 |
| 8,210,968 | B2 * | 7/2012 | Chen | A47B 25/003 | 473/433 |
| 2002/0068650 | A1 * | 6/2002 | Wang | A63B 63/083 | 473/479 |
| 2006/0154751 | A1 * | 7/2006 | Huntsberger | A63B 24/0021 | 473/433 |
| 2008/0042358 | A1 * | 2/2008 | Chen | A63B 69/0071 | 273/317.3 |
| 2008/0252018 | A1 * | 10/2008 | Chung | A63B 24/0021 | 273/402 |
| 2010/0248866 | A1 * | 9/2010 | Johnson | A63B 63/083 | 473/433 |
| 2015/0051023 | A1 * | 2/2015 | Aipperspach | A63B 69/0071 | 473/433 |
| 2016/0144256 | A1 * | 5/2016 | Lee | A63B 69/0071 | 473/416 |

* cited by examiner

PORTABLE BASKETBALL ARCADE

FIELD OF THE DISCLOSURE

The present invention relates to the technical field of sports facilities, and in particular to a portable basketball arcade.

BACKGROUND

With improvement in people's living standards, more physical exercises have entered people's life. As a physical exercise mode, basketball is deeply popular among different crowds, and therefore the demand on a basketball arcade is increased gradually. However, at present, since available basketball arcades are scarce and the price of some charging basketball courts is too high, basketball fans cannot shoulder the heavy economic burden, thereby reducing the opportunity for the basketball fans to play basketball, and restricting an integral level of the basketball fans.

CN201620757753.1 provides a portable basketball arcade, which can be detached and mounted and is small in occupied space after detachment and is convenient to move. A base is provided with a storage box, a greater humanized effect is realized, and it is convenient to store the personal belongings of players. But such portable basketball arcade is still heavy and needs to be detached or mounted by tools.

SUMMARY

The present invention provides a portable basketball arcade, including a backboard; at least one basketball hoop, wherein the at least one basketball hoop is movably installed on the backboard; two telescopic support upright rods, installed on both sides of the backboard respectively; two telescopic support bottom rods, wherein an end of each of the two telescopic support bottom rods is pivotally connected to a bottom end of each of the two telescopic support upright rods respectively; two telescopic reinforcing rods, wherein an end of each of the two telescopic reinforcing rods is pivotally connected to each of the two telescopic support upright rods respectively, and another end of each of the two telescopic reinforcing rods is connected to the two telescopic support bottom rods respectively; and a support bottom rod, wherein both ends thereof are connected to the bottom ends of the two telescopic support upright rods respectively.

In one embodiment, the two telescopic support upright rods comprise at least two telescopic rods respectively.

In one embodiment, the two telescopic support bottom rods comprise at least two telescopic rods respectively.

In one embodiment, the two telescopic reinforcing rods comprise at least two telescopic rods respectively.

In one embodiment, the portable basketball arcade further comprises a door-shaped connecting rod and a ball receiving plate, wherein both ends of the door-shaped connecting rod are pivotally connected to the other ends of the two telescopic support bottom rods respectively, and both sides of the ball receiving plate are connected to the backboard and the door-shaped connecting rod respectively.

In one embodiment, both sides of the backboard are provided with a side net hanging rod respectively.

In one embodiment, the ball receiving plate is made of nylon fabric.

In one embodiment, the backboard is provided with at least one support plate, and the at least one support plate is correspondingly installed below the at least one basketball rim.

The above portable basketball arcade is simple in structure, by pivoting connection of a plurality of telescopic rods, the angles among respective rods and the height of the basketball arcade are convenient to adjust, such that different heights and distances are provided for users to practice, the portable basketball arcade can be simply and rapidly folded and stored without a need of tools, and the folded basketball arcade is small in occupied space, and convenient to carry and lift; and the basketball arcade is equipped with the ball receiving plate and the side nets, which are convenient for the users to pick up the ball for practice.

BRIEF DESCRIPTION OF THE DRAWINGS

The accompanying drawings illustrated here are provided for further explain the present application and form part of the present application. The illustrative embodiments and explanation thereof of the present application are intended to explain the present application without limiting the present application improperly. In the accompanying drawings.

DETAILED DESCRIPTION OF PREFERRED EMBODIMENTS

The preferred embodiments of the present invention are disclosed with drawings. For the purpose of clear explanation, many practical details will be explained in the following description. However, it should be understood that these practical details are not applied to limit the present invention. That is to say, in part of embodiments of the present invention, these practical details are unnecessary. In addition, in order for simplifying the drawings, some well-known and conventional structures and components will be drawn in a simply schematic manner.

The "first, "second", etc., used in the text do not refer to an order or sequence particularly, are not intended to limit the present application either, but are merely intended to differentiate the components or operations described by the same technical terms.

Figure 1:
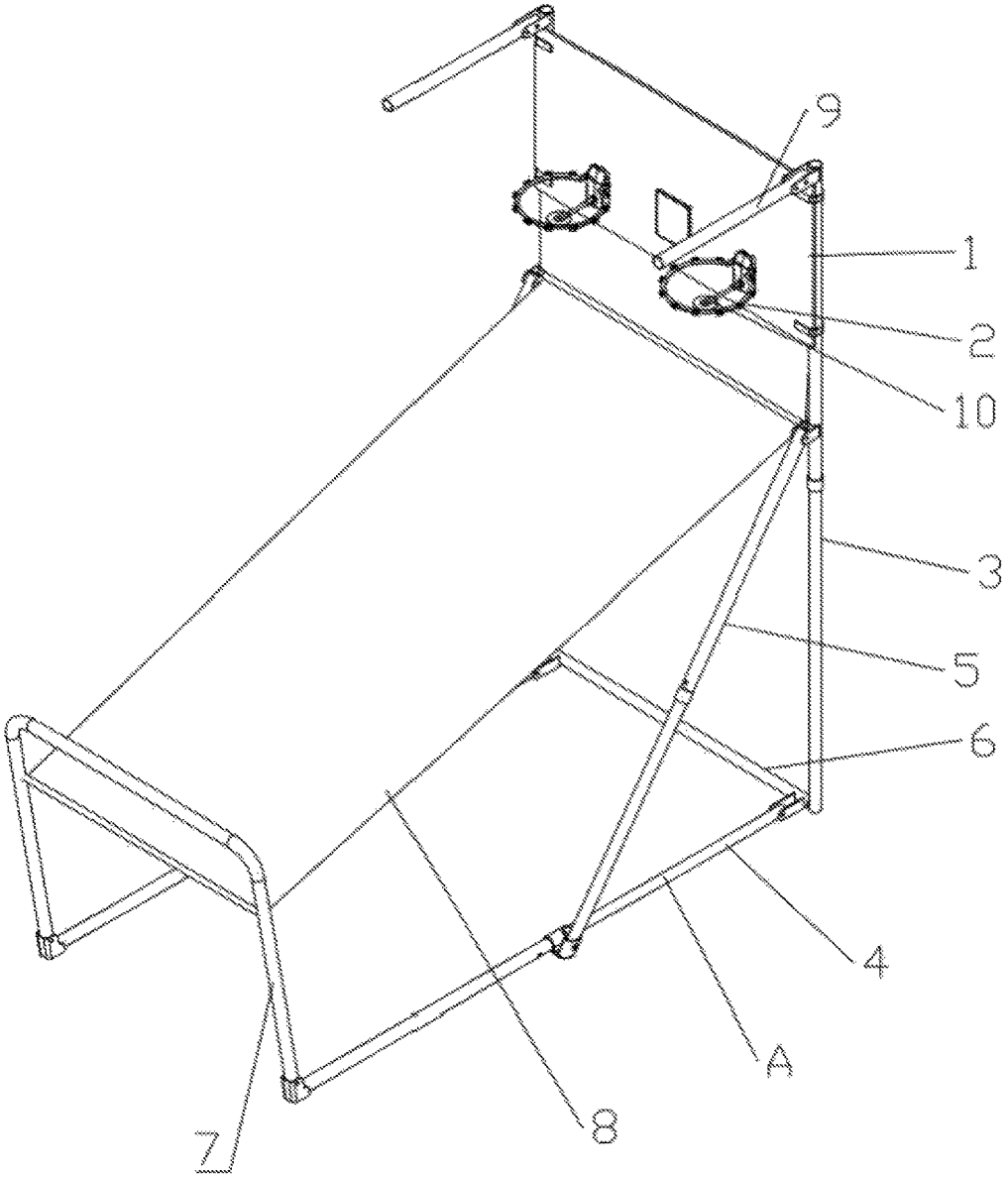
FIG. 1 is an unfolding schematic view of a portable basketball arcade of the present application.
Figure 2:
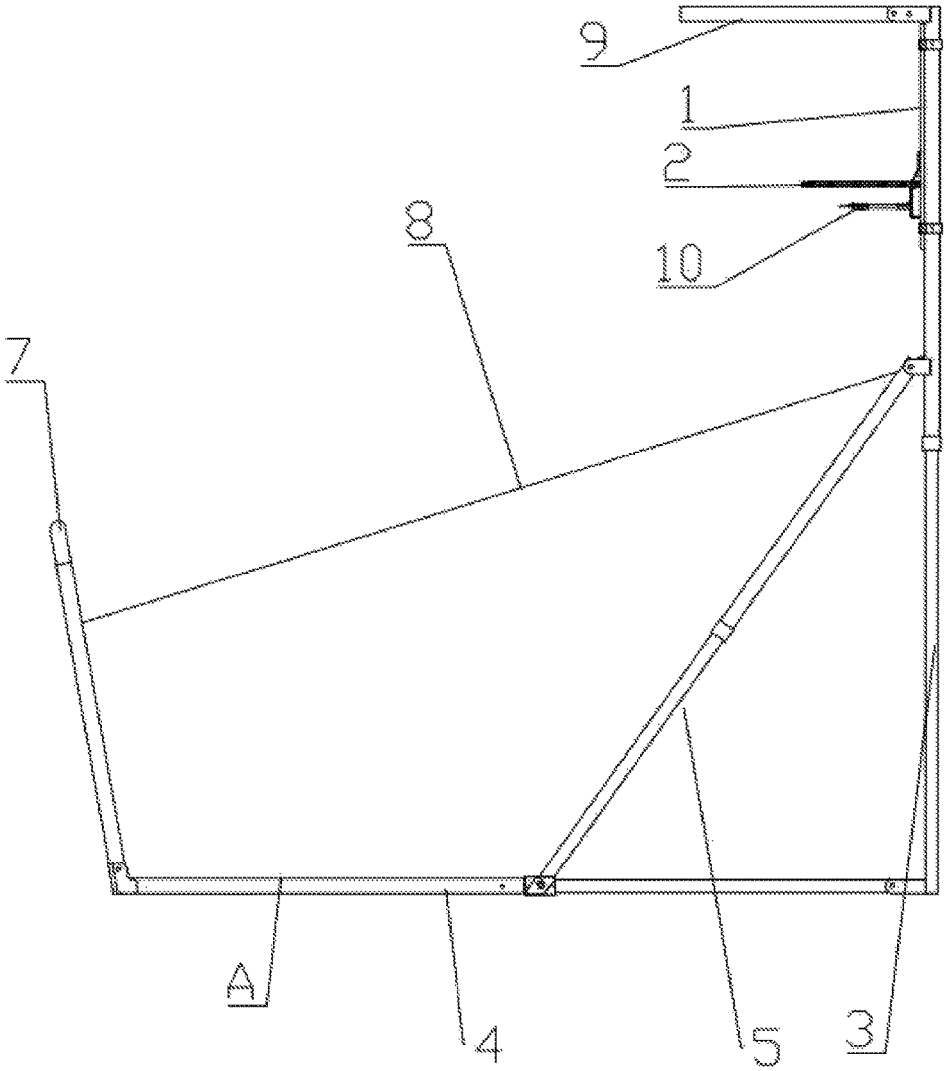
FIG. 2 is an unfolding side view of the portable basketball arcade of the present application.

The present application provides a portable basketball arcade. Referring to FIGS. 1 and 2, which are an unfolding schematic view and an unfolding side view respectively of the portable basketball arcade of the present application, as shown in the figures, the portable basketball arcade of the present application includes a backboard 1, two basketball rims 2, two telescopic support upright rods 3, two telescopic support bottom rods 4, two telescopic reinforcing rods 5 and a support bottom rod 6. Wherein the two basketball rims 2 are movably installed on the backboard 1 respectively, and the two telescopic support upright rods 3 are installed on both sides of the backboard 1 respectively. An end of each of the two telescopic support bottom rods 4 is pivotally connected to a bottom end of each of the two telescopic support upright rods 3 respectively. An end of each of the two telescopic reinforcing rods 5 is pivotally connected to each of the two telescopic support upright rods 3 respectively, and another end of each of the two telescopic reinforcing rods 5 is connected to each of the two telescopic support bottom rods 4 respectively. That is, the single telescopic support upright rod 3, the single corresponding telescopic support bottom rod 4 and the single corresponding telescopic reinforcing rod 5 define a right triangle. By the right triangle structures installed on both sides of the backboard 1 respectively, the basketball arcade is steadied, such that the basketball arcade will not topple over due to an impact of the basketball. Meanwhile, the both ends of the support bottom rods 4 are connected to the bottom ends of the two telescopic support upright rods 3 respectively, thereby further strengthening and reinforcing the steadiness when the two right triangles are vertical, and fixing an interval between the two right triangles.

Further, the two telescopic support upright rods 3 include at least two telescopic rods A respectively, the two telescopic support bottom rods 4 include at least two telescopic rods A respectively, and the two telescopic reinforcing rods 5 include at least two telescopic rods A respectively. A height of the basketball arcade is adjusted by the multiple telescopic rods A, such that different requirements of the users on the height are met.

Further, the portable basketball arcade according to the present application further includes a door-shaped (such as "⊓"-shaped) connecting rod 7 and a ball receiving plate 8. Both ends of the bottom of the door-shaped connecting rod 7 are pivotally connected to the other ends of the two telescopic support bottom rods 4 respectively. When the portable basketball arcade according to the present application is unfolded for use, the door-shaped connecting rod 7 is vertical on the two telescopic support bottom rods 4. The ball receiving plate 8 is located below the basketball rims 2, and both sides of the ball receiving plate are connected to the bottom end of the backboard 1 and the top end of the door-shaped connecting rod 7 respectively. The ball receiving plate 8 can be sufficiently unfolded by the backboard 1 and the door-shaped connecting rod 7. Preferably, the ball receiving plate is of nylon fabric, is long in service life and can be used for ball receiving only by unfolding due to the characteristics of waterproofness, lightness and toughness and durability of the nylon fabric.

Further, both sides of the backboard 1 are provided with a side net hanging rod 9 respectively, and the side net hanging rods 9 are used for hanging side nets (not shown in the figure). An end of each of the side nets is connected to each of the side net hanging rods 9, and another end of each of the side nets is connected to each of the door-shaped connecting rods 7, thereby unfolding the side nets. The side nets are hung on the two ends of the backboard 1, are configured to intercept the basketball and are convenient for the user to pick up the ball.

Preferably, the backboard 1 is provided with two support plates 10, and the two support plates 10 are correspondingly installed below the two basketball rims 2. After the user throws the basketball into one of the two basketball rims 2, the basketball penetrates through the basketball rim 2 and falls down to touch the corresponding support plate 10, and the support plate 10 is impacted to swing, thereby intuitively indicating successful shooting, and assisting the user in scoring.

Figure 3:
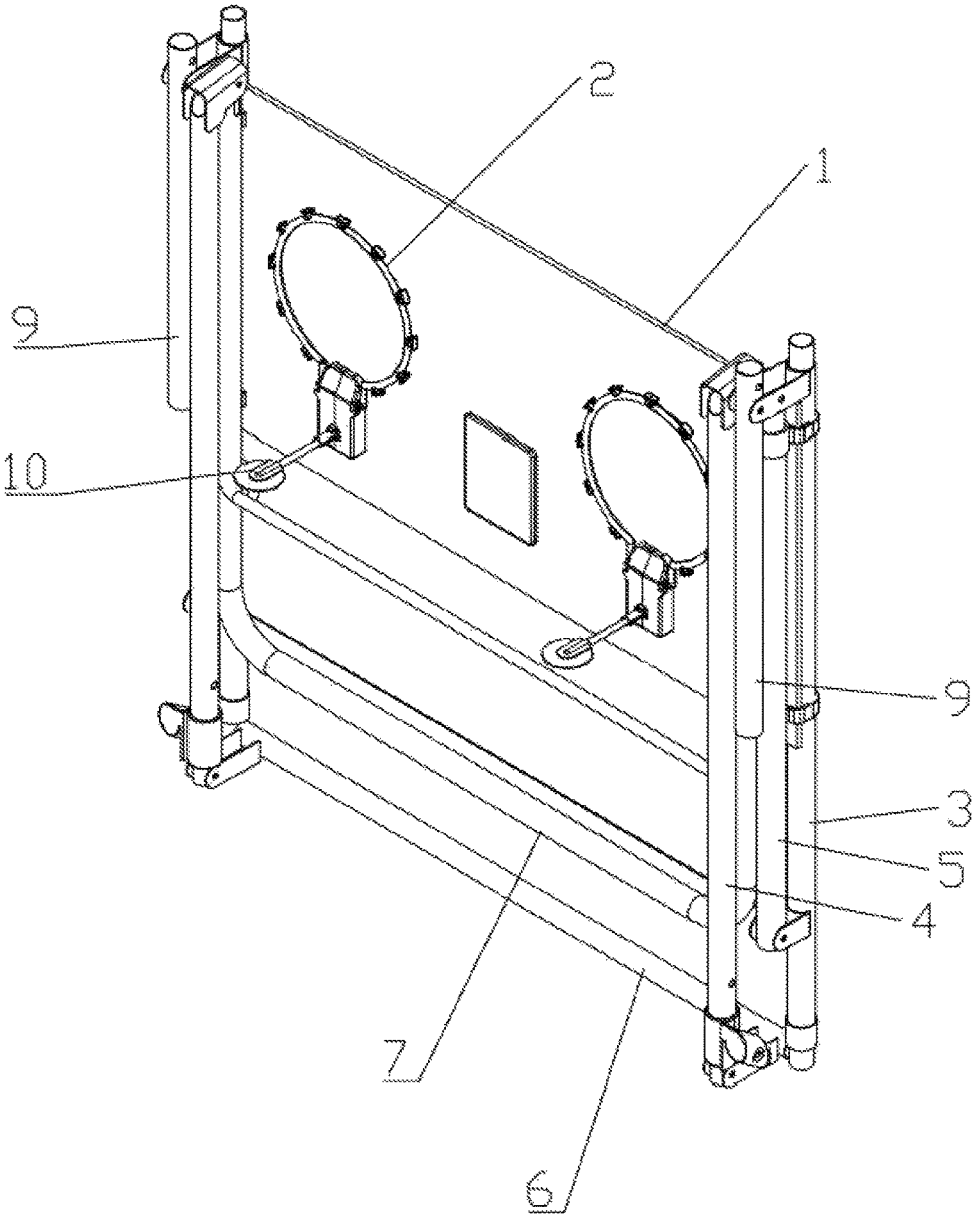
FIG. 3 is a folding schematic view of the portable basketball arcade of the present application.
Figure 4:
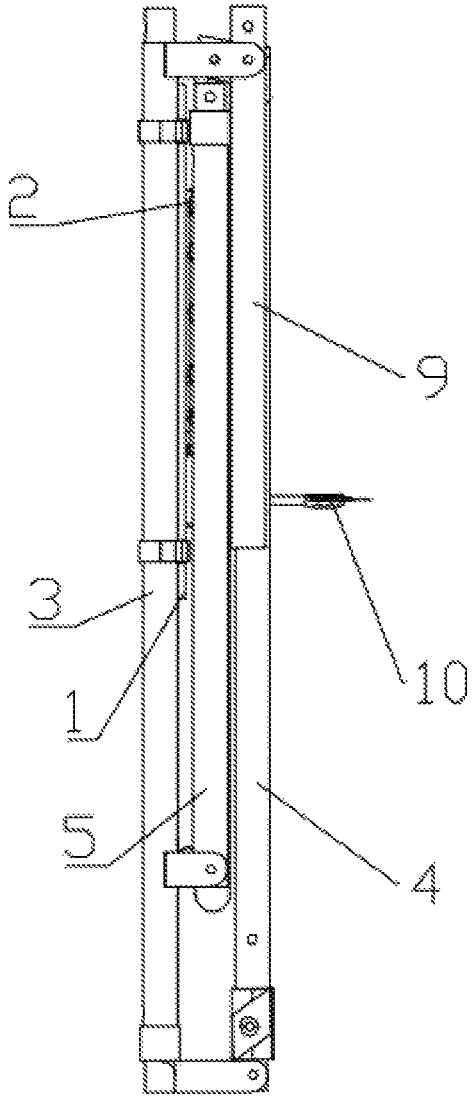
FIG. 4 is a folding side view of the portable basketball arcade of the present application.

FIGS. 3 and 4 are referred and a folding schematic view and a folding side view of the portable basketball arcade of the present application. As shown in the figures, after the user completely uses the portable basketball arcade according to the present application, the portable basketball arcade needs to be folded and stored. At first, the two basketball rims 2 are folded to be flatly attached to the backboard 1, then the door-shaped connecting rod 7 is folded to be parallel with the two telescopic support bottom rods 4, and then the two telescopic support upright rods 3, the two telescopic support bottom rods 4 and the two telescopic reinforcing rods 5 are contracted to be a shortest state. Meanwhile, the ball receiving plate 8 is curled and folded, and finally the two side net hanging rods 9 are folded to be parallel with the two telescopic support upright rods 3, thereby finishing the folding and storing actions of the portable basketball arcade according to the present application. When needing to be used again, the portable basketball arcade can be unfolded in a reverse direction, which is not repeated here.

In conclusion, the above portable basketball arcade is simple in structure, by pivoting connection of a plurality of telescopic rods, the angles among respective rods and the height of the basketball arcade are convenient to adjust, such that different heights and distances are provided for the users to practice, the portable basketball arcade can be simply and rapidly folded and stored without a need of tools, and the folded basketball arcade is small in occupied space, and convenient to carry and lift. The basketball arcade is equipped with the ball receiving plate and the side nets, which are convenient for the users to pick up the ball for practice.

The foregoing is merely embodiments of the present invention and is not intended to limit the present invention. Those skilled in the art can perform various alterations and changes on the present invention. Any modifications, equivalent replacements, improvements, etc., made within a spirit and principle of the present invention should be included in the scope of claims of the present invention.

What is claimed is:

1. A portable basketball arcade, comprising:

a backboard;

at least one basketball rim, wherein the at least one basketball rim is movably installed on the backboard;

two telescopic support upright rods, installed on both sides of the backboard respectively;

two telescopic support bottom rods, wherein an end of each of the two telescopic support bottom rods is pivotally connected to a bottom end of each of the two telescopic support upright rods respectively;

two telescopic reinforcing rods, wherein an end of each of the two telescopic reinforcing rods is pivotally connected to each of the two telescopic support upright rods respectively, and another end of each of the two telescopic reinforcing rods is connected to the two telescopic support bottom rods respectively; and a support bottom rod, wherein both ends thereof are connected to the bottom ends of the two telescopic support upright rods respectively.

2. The portable basketball arcade according to claim 1, wherein the two telescopic support upright rods comprise at least two telescopic rods respectively.

3. The portable basketball arcade according to claim 1, wherein the two telescopic support bottom rods comprise at least two telescopic rods respectively.

4. The portable basketball arcade according to claim 1, wherein the two telescopic reinforcing rods comprise at least two telescopic rods respectively.

5. The portable basketball arcade according to claim 1, wherein the portable basketball arcade further comprises a door-shaped connecting rod and a ball receiving plate, wherein ends of the door-shaped connecting rod are pivotally connected to the other ends of the two telescopic support bottom rods respectively, and sides of the ball receiving plate are connected to the backboard and the door-shaped connecting rod respectively.

6. The portable basketball arcade according to claim 2, wherein the portable basketball arcade further comprises a door-shaped connecting rod and a ball receiving plate, wherein ends of the door-shaped connecting rod are pivotally connected to the other ends of the two telescopic support bottom rods respectively, and sides of the ball receiving plate are connected to the backboard and the door-shaped connecting rod respectively.

7. The portable basketball, arcade according to claim 3, wherein the portable basketball arcade further comprises a door-shaped connecting rod and a ball receiving plate, wherein ends of the door-shaped connecting rod are pivotally connected to the other ends of the two telescopic support bottom rods respectively, and sides of the ball receiving plate are connected to the backboard and the door-shaped connecting rod respectively.

8. The portable basketball arcade according to claim 4, wherein the portable basketball arcade further comprises a door-shaped connecting rod and a ball receiving plate, wherein ends of the door-shaped connecting rod are pivotally connected to the other ends of the two telescopic support bottom rods respectively, and sides of the ball receiving plate are connected to the backboard and the door-shaped connecting rod respectively.

9. The portable basketball arcade according to claim 5, wherein the ball receiving plate is made of nylon fabric.

10. The portable basketball arcade according to claim 6, wherein the ball receiving plate is made of nylon fabric.

11. The portable basketball arcade according to claim 7, wherein the ball receiving plate is made of nylon fabric.

12. The portable basketball arcade according to claim 8, wherein the ball receiving plate is made of nylon fabric.

13. The portable basketball arcade according to claim 1, wherein sides of the backboard are provided with a side net hanging rod respectively.

14. The portable basketball arcade according to claim 2, wherein sides of the backboard are provided with a side net hanging rod respectively.

15. The portable basketball arcade according to claim 3, wherein sides of the backboard are provided with a side net hanging rod respectively.

16. The portable basketball arcade according to claim 4, wherein sides of the backboard are provided with a side net hanging rod respectively.

17. The portable basketball arcade according to claim 1, wherein the backboard is provided with at least one support plate, and the at least one support plate is correspondingly installed below the at least one basketball rim.

18. The portable basketball arcade according to claim 2, wherein the backboard is provided with at least one support plate, and the at least one support plate is correspondingly installed below the at least one basketball rim.

19. The portable basketball arcade according to claim 3, wherein the backboard is provided with at least one support plate, and the at least one support plate is correspondingly installed below the at least one basketball rim.

20. The portable basketball arcade according to claim 4, wherein the backboard is provided with at least one support plate, and the at least one support plate is correspondingly installed below the at least one basketball rim.

* * * * *